US005427877A

United States Patent [19]

Green et al.

[11] Patent Number: 5,427,877

[45] Date of Patent: Jun. 27, 1995

[54] METHOD AND APPARATUS FOR CONTROLLING AN AUTOMATIC SILVER RECOVERY SYSTEM FOR A PHOTOGRAPHIC PROCESSOR

[75] Inventors: Andrew Green, Harrow; Gerhard Ueffinger, Weinstadt-Grossheppach; Gerd Hoitz, Unterensingen, all of Germany

[73] Assignee: Eastman Kodak Company, Rochester, N.Y.

[21] Appl. No.: 159,355

[22] Filed: Nov. 30, 1993

[30] Foreign Application Priority Data

Dec. 2, 1992 [DE] Germany ..... 42 40 433.9

[51] Int. Cl.[6] ..... C25C 1/00; G03D 15/00; G03C 3/00; G03C 5/00

[52] U.S. Cl. ..... 430/30; 430/398; 430/400; 204/109; 204/149; 204/228

[58] Field of Search ..... 430/30, 398, 400; 204/109, 149, 228

[56] References Cited

U.S. PATENT DOCUMENTS

| | | | |
|---|---|---|---|
| 3,418,225 | 12/1968 | Wick et al. | 204/109 |
| 3,463,711 | 8/1969 | Geyken | 204/109 |
| 3,616,435 | 10/1971 | Favell et al. | 204/228 |
| 3,828,172 | 8/1974 | Schickler | 430/30 |
| 3,980,538 | 9/1976 | Higgins | 204/109 |
| 4,078,983 | 3/1978 | Higgins | 204/228 |
| 4,127,465 | 11/1978 | Higgins | 204/228 |
| 4,211,630 | 7/1980 | Blake et al. | 430/400 |
| 4,619,749 | 10/1986 | Nusbaum | 204/228 |
| 5,279,930 | 1/1994 | Green et al. | 430/398 |
| 5,300,199 | 4/1994 | Fyson | 204/109 |

FOREIGN PATENT DOCUMENTS

| | | | |
|---|---|---|---|
| 2133450 | 12/1972 | France | 204/228 |
| 2520367 | 11/1975 | Germany | 204/109 |
| 2552069 | 5/1977 | Germany . | |
| 2838784 | 3/1979 | Germany | 430/398 |
| 4127454 | 2/1993 | Germany | 430/400 |
| 56-92537 | 7/1981 | Japan | 430/30 |
| 8304038 | 6/1985 | Netherlands | 204/109 |
| WO90/15362 | 12/1990 | WIPO . | |

*Primary Examiner*—Charles L. Bowers, Jr.
*Assistant Examiner*—J. Pasterczyk
*Attorney, Agent, or Firm*—Frank Pincelli

[57] ABSTRACT

A method and apparatus for controlling an electrolytic silver recovery system for a photographic processor, the control being effected in response to the surface area of the photosensitive material moved through the processing solutions. The apparatus determines the amount of silver deposited in the fixing bath of the processor from the width, length and density of the photosensitive material and used as an electrical signal for controlling the electrolytic current of the silver recovery system.

6 Claims, 2 Drawing Sheets

METHOD AND APPARATUS FOR CONTROLLING AN AUTOMATIC SILVER RECOVERY SYSTEM FOR A PHOTOGRAPHIC PROCESSOR

FIELD OF THE INVENTION

The invention relates to a method and apparatus for controlling an electrolytic silver recovery system for a photographic processor, the control being effected in response to the surface area of the photosensitive material moved through the processing solutions.

BACKGROUND OF THE INVENTION

Methods of this type in which a signal is gained from the processor which is proportional to the processed film or paper area and, thus, also proportional to the amount of silver deposited in the fixing bath of the processor, are known. In DE-PS 1 188 822, for example, a method is described for electrolytically recovering silver in which recovery is controlled by turning on and off the electrolytic current in response to the amount of photographic material moved through the fixing bath. The surface area of the material to be processed is the basic parameter therefor, assuming that on average always identical amounts of silver are dissolved from the material.

In DE-PS 1 237 789 the operating cycle of the silver recovery system is determined by a pulse generator activated by the film material moved through the processor, with the possibility of storing the pulses. In this case as well, the surface area of the material to be processed is the decisive factor and, as a result, only an average amount of silver to be recovered from the photosensitive material is used as a basic parameter.

The disadvantage of such methods is that the amount of silver in the fixing bath is averaged and used as a basic parameter by means of which the electrolytic silver recovery system is controlled.

On the other hand, silver recovery systems are known that operate in response to the silver content of the fixing solution forming an electronic reference value. The reference value may be, for example, the cathode potential of a reference electrode that is proportional to the silver concentration. There is a disadvantage, however, in that a continuity of the value determined by the silver content can hardly be realized over an extended period of time so that the recovery system is not very reliably and exactly controlled.

SUMMARY OF THE INVENTION

It is the object of the invention to provide a method for controlling a silver recovery system for a photographic processor in which method the amount of silver deposited in the fixing bath is reliably and exactly determined and used for controlling the system.

According to the invention, the above object is attained in that the amount of silver deposited in the fixing bath of a processor is determined from the width, length and density of the photosensitive material and used as an electrical signal for controlling the electrolytic current of the silver recovery system. The amount of silver present in the fixing bath and the electrolytic current controlled accordingly are determined every ten seconds. It is thereby advantageously achieved that the electrolytic current is adapted to the actual amount of silver and thus an optimum silver recovery is possible. When a predetermined amount of silver has been deposited on the cathode, the power supply of the recovery system is cut off.

For performing the method according to the invention an apparatus is proposed by means of which the surface area and density of the photosensitive material is determined with the aid of optoelectronic sensor elements formed of a transmitted light operated IR transmitter/receiver arrangement and of an IR reflective sensor arrangement which are arranged in rows and alternate across the width of the apparatus. The apparatus according to the invention permits, within a large density range of the photosensitive material, a reliable and accurate determination of the density and the surface area of the material and, thus, of the amount of silver contained in the fixing bath. As a result, the electrical signal used for controlling the silver recovery system is also proportional to the amount of silver contained in the fixing bath so that advantageously a control is realized in that the recovery of the silver is based on the actual amount of silver gained from the photosensitive material. Moreover, a substantial reduction of replenishment of the fixing bath will be obtained.

DESCRIPTION OF THE DRAWINGS

The invention will now be described in detail with reference to the drawing wherein.

DETAILED DESCRIPTION OF THE INVENTION

Figure 1:
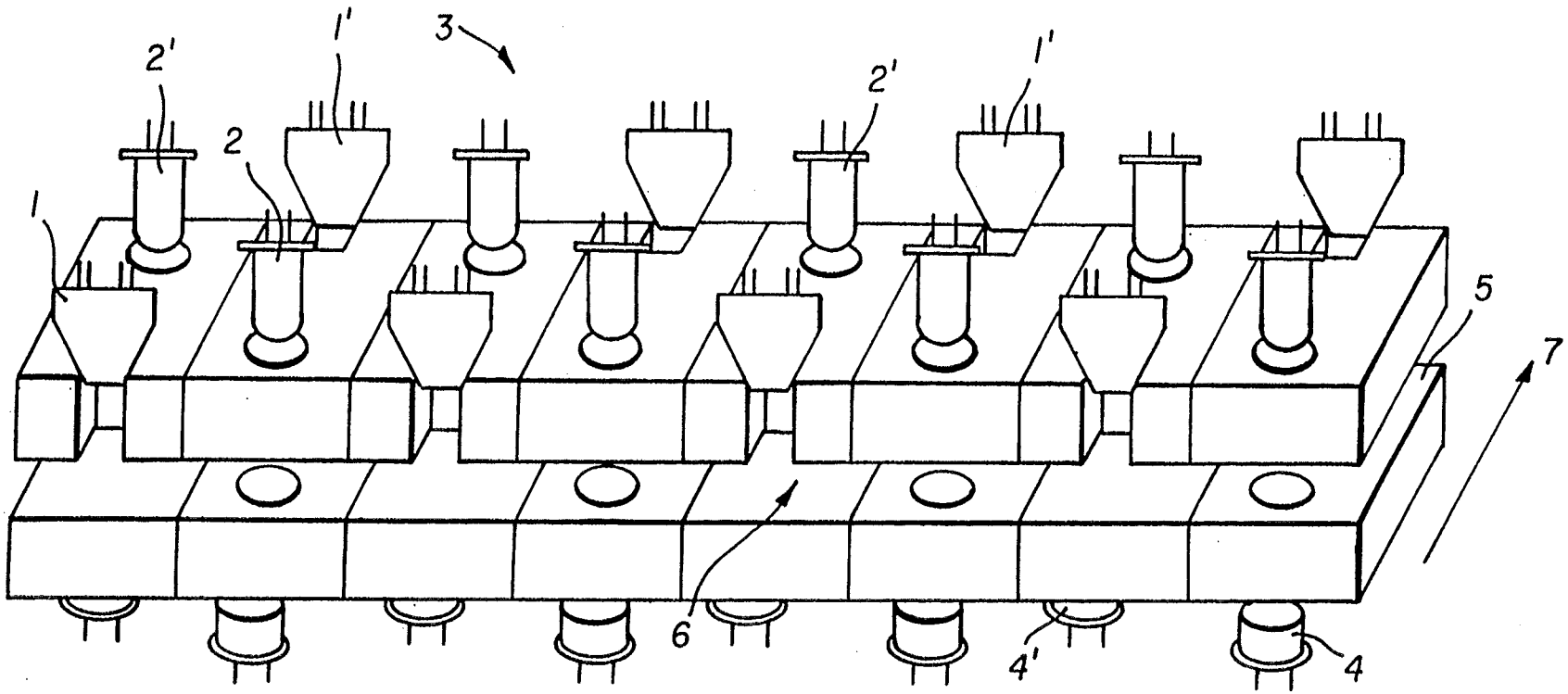
FIG. 1 shows the apparatus for performing the method.

In advancing direction 7 of the photosensitive material the apparatus 3 shown in FIG. 1 comprises two rows of IR transmitters 2, 2' with oppositely arranged receivers 4, 4' and IR reflective sensors 1, 1' spaced at regular intervals. Arrangement of the IR sensors with respect to the longitudinal side 6 of the apparatus is such that in each of the two rows an IR transmitter 2, 2' with a receiver 4, 4' is followed by an IR reflective sensor 1, 1'. The IR transmitters 2, 2' consist of infrared LED's and the receivers 4, 4' are formed of photocells. Across the total width of the apparatus 3 at least eight IR transmitter/receiver sensors and eight IR reflective sensors are arranged per row. By means of rollers not illustrated the photosensitive material is moved through slot 5 in direction 7.

Figure 2:
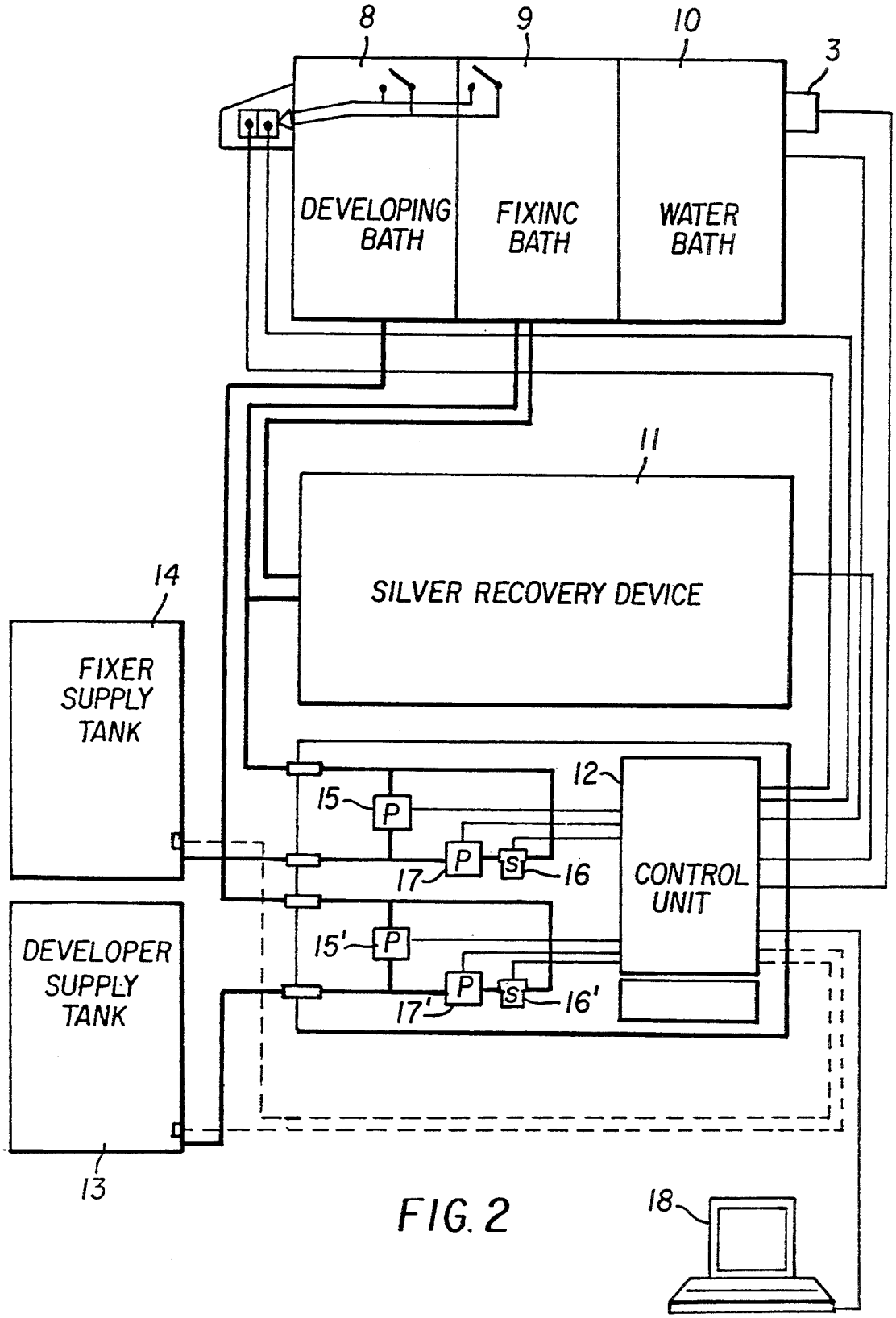
FIG. 2 shows a schematic of a known processor with the apparatus according to the invention installed therein.

As shown in FIG. 2, the apparatus 3 is placed downstream of a processor substantially formed of three main assemblies:

- the processing tanks containing a developing bath 8 and a fixing bath 9 provided with level sensors, a water bath 10 and a drying station;
- a silver recovery system 11; and
- a replenishing means consisting of pumps 15, 15' and 17, 17' and a pressure switch 16, 16' supply tanks 13, 14 for developing and fixing solutions and a control unit 12 operable via a computer 18 and comprising a microprocessor.

The developing bath 8 is connected to supply tank 13 by means of pipes with parallelly operating pumps 15 and 17 interposed. The fixing bath 9, on the one hand, is connected via pipes to the electrolytically operating silver recovery system 11 and, on the other, to supply tank 14 with pumps 15' and 17' interposed as well.

The method is described as follows:

The photosensitive material, film or paper, moves through the processor in a known way, that is to say from the developing bath 8 to the fixing bath 9, the water bath 10 and then to the drying station from which it is advanced into slot 5 of the apparatus 3. As soon as the leading edge of the material moves beneath the first row of the reflective IR sensors 1 a signal is produced and a time measurement is started by the microprocessor control unit 12. Then the density of the photosensitive material is measured by the transmitted light operated IR transmitter/receiver sensors 2, 2' and 4, 4'. When the leading edge of the material moves through the IR reflective sensors 1' in the second row, the time lapsed since the start of the time measurement is determined. Using the values from the time lapse and the known spacing between the first and second row of the IR reflective sensors 1, 1', the transport speed is calculated.

The width of the film or paper is determined from the number of IR transmitter/receiver sensors 2, 4 and 2', 4' that detect light reflected by the material and produce a signal. When the trailing edge of the material moves through the first row of the IR reflective sensor, time measurement is terminated. The total time then corresponds to the duration the film has taken to move through the processing solutions by means of which value the length of the material is calculated in response to the transport speed. The surface area processed will result from the length and width of the material.

During the time the material moves between the IR transmitter/receiver sensors 2, 2' and 4, 4' its density is determined. If no spot on the material shows a density below a predetermined value stored in the microprocessor of the control unit, the type of the material, film or paper, can be determined. The surface area, density and type of material being known, the control unit 12 calculates, by means of a program stored in the microprocessor, the required amounts of replenisher for the developing and fixing solutions. Depending on the amounts calculated, the replenishing pumps for developer, fixer and water are switched on for a predetermined period. Moreover, a value is determined in the control unit 12 the calculation of which is based on the surface area and the density of the material and corresponds to the amount of silver deposited in the fixing bath. Said value is fed to the silver recovery system 11. When further film material is fed into the processor, the value corresponding to the amount of silver actually contained in the fixing bath is added to the aforementioned-value, the total being used as a signal for controlling the electrolytic current of the silver recovery system 11 so that the electrolytic current is controlled as a function of the silver concentration in the fixing bath. Every ten seconds the actual amount of silver contained in the fixing bath is determined and the electrolytic current adapted accordingly. By means of a program stored in the microprocessor of the control unit 12 and considering experimentally determined efficiency values also the amount of silver electrolytically recovered and deposited on the cathode is calculated and subtracted from the amount of silver contained in the fixing bath. When a predetermined amount of silver has been deposited on the cathode, the silver recovery system is cut off.

Parts List

1,1' . . . IR reflective sensors
2,2' . . . IR transmitters
3 . . . apparatus
4,4' . . . receivers
5 . . . slot
6 . . . longitudinal side
7 . . . advancing direction
8 . . . bath
9 . . . fixing bath
10 . . . water bath
11 . . . silver recovery system
12 . . . control unit
13,14 . . . supply tanks
15,17 . . . pumps
16 . . . pressure switch

We claim:

1. A method for controlling an electrolytic silver recovery apparatus for use with a photographic processor for black and white silver-based photographic film having tanks for separately containing developer and fixing solutions for developing and fixing of a silver based photographic film, the electrolytic silver recovery apparatus being controlled in response to the area of the silver based photographic film moved through said developer and fixing solutions, characterized in that the amount of silver deposited in the fixing solution is determined from the area and optical density of the photographic film and is used to generate an electrical signal for controlling electrolytic current of the silver recovery apparatus.

2. A method according to claim 1, wherein in that the amount of silver contained in the fixing solution and the electrolytic current controlling the electrolytic silver recovery apparatus are determined every 10 seconds.

3. A method according to claim 1, wherein the electrolytic silver recovery apparatus includes a cathode and the power supplied to the silver recovery apparatus is cut off when a predetermined amount of silver has been deposited on the cathode.

4. A method according to claim 2, wherein the electrolytic silver recovery apparatus includes a cathode and the power supplied to the silver recovery apparatus is cut off when a predetermined amount of silver has been deposited on the cathode.

5. An electrolytic silver recovery apparatus for use in a photographic processor designed to process silver based photographic black and white film, said processor having tanks for separately containing developer and fixing solution for developing and fixing of the silver based photographic film, said electrolytic silver recovery apparatus having sensing means for determining the width, length and optical density of the silver halide photosensitive film that has been processed through the photographic processor, characterized in that the sensing means for determining the width, length and optical density comprises an IR transmitter/receiver arrangement for sensing the light transmitted through said silver based photographic material and an IR reflective sensor arrangement for sensing the light reflected from said photographic material, and that said IR transmitter/receiver arrangement and said IR reflective sensor arrangement are arranged in rows and alternate across the width of the sensing means.

6. A photographic film processor having a plurality of tanks for separately holding developing, fixing and washing solutions for processing of a black and white silver based photographic film, said processor having an electrolytic silver recovery apparatus for recovering silver from the fixing solution, the electrolytic silver recovery apparatus having a cathode for depositing of recovered silver from said fixing solution contained in said tank, said electrolytic silver recovery apparatus having means for determining the width, length and optical density of the photographic film that has been processed by the processor which is used to generate an electrical signal for controlling the electrolytic current of the silver recovery apparatus.

* * * * *